US007032518B2

(12) United States Patent
Scheffer et al.

(10) Patent No.: US 7,032,518 B2
(45) Date of Patent: Apr. 25, 2006

(54) METHOD AND SYSTEM FOR MANAGING TENSION AND MAINTAINING REGISTRATION BETWEEN MULTIPLE WEBS IN A WEB FINISHING SYSTEM

(75) Inventors: Bruce Scheffer, Valpariso, IN (US); Eric K. Lo, Hobart, IN (US); John Nader, Hebron, IN (US); Tom Payer, Valparaiso, IN (US)

(73) Assignee: Scheffer, Inc., Valparaiso, IN (US)

( * ) Notice: Subject to any disclaimer, the term of this patent is extended or adjusted under 35 U.S.C. 154(b) by 0 days.

(21) Appl. No.: 10/710,867

(22) Filed: Aug. 9, 2004

(65) Prior Publication Data

US 2005/0028701 A1 Feb. 10, 2005

Related U.S. Application Data

(60) Provisional application No. 60/481,188, filed on Aug. 7, 2003.

(51) Int. Cl.

| | |
|---|---|
| ***B41F 1/34*** | (2006.01) |
| ***B41F 13/56*** | (2006.01) |
| ***B41L 3/02*** | (2006.01) |
| ***B23D 25/02*** | (2006.01) |
| ***B23Q 15/00*** | (2006.01) |

(52) U.S. Cl. ..... 101/485; 101/225; 101/226; 101/227; 101/217; 101/171; 101/486; 83/38; 83/74

(58) Field of Classification Search ..... 101/485, 101/225–227, 217, 171, 486; 226/2, 27; 83/74, 38

See application file for complete search history.

(56) References Cited

U.S. PATENT DOCUMENTS

| | | | | |
|---|---|---|---|---|
| 4,380,943 | A * | 4/1983 | Evans | 83/38 |
| 4,955,265 | A * | 9/1990 | Nakagawa et al. | 83/74 |
| 5,056,431 | A * | 10/1991 | Sainio | 101/219 |
| 5,224,640 | A * | 7/1993 | Fokos et al. | 226/27 |
| 5,299,496 | A * | 4/1994 | Martin et al. | 101/181 |
| 5,361,960 | A * | 11/1994 | Fokos et al. | 226/2 |
| 5,458,062 | A * | 10/1995 | Goldberg et al. | 101/485 |
| 5,483,893 | A * | 1/1996 | Isaac et al. | 101/485 |
| 5,501,148 | A * | 3/1996 | Bellio et al. | 101/232 |
| 5,640,835 | A * | 6/1997 | Muscoplat | 53/569 |
| 5,865,118 | A * | 2/1999 | Fromson et al. | 101/463.1 |
| 6,321,650 | B1 * | 11/2001 | Ogawa et al. | 101/227 |
| 6,568,323 | B1 * | 5/2003 | Tokiwa | 101/227 |

(Continued)

*Primary Examiner*—Andrew H. Hirshfeld
*Assistant Examiner*—Wasseem H. Hamdan
(74) *Attorney, Agent, or Firm*—Gary M. Hartman; Domenica N. S. Hartman; Hartman & Hartman

(57) ABSTRACT

A system and method for managing the tension and maintaining registration between multiple webs in a web finishing system. The method involves transporting a first web and at least second web toward a finishing apparatus, comparing relative positions of registration marks on the webs, severing lengths of the second web in response to the relative positions, aligning each length of the second web with the first web, and then performing a finishing operation on the webs with the finishing apparatus. The system includes the finishing apparatus, devices for transporting the webs toward the finishing apparatus, devices for comparing the relative positions of the registration marks on the webs, a device for severing lengths of the second web in response to the relative positions, and a device for individually aligning each length of the second web with the first web before the webs encounter the finishing apparatus.

20 Claims, 3 Drawing Sheets

U.S. PATENT DOCUMENTS 6,626,102 B1 * 9/2003 Tokiwa ..... 101/226
6,786,149 B1 * 9/2004 Lomoine et al. ..... 101/223
6,796,240 B1 * 9/2004 Sainio et al. ..... 101/485
6,899,026 B1 * 5/2005 Weis ..... 101/225
2001/0054360 A1 * 12/2001 Tokiwa ..... 101/226
2002/0164103 A1 * 11/2002 Shekel et al. ..... 385/8
2003/0136283 A1 * 7/2003 Tokiwa ..... 101/226
2003/0172821 A1 * 9/2003 Elsner ..... 101/227

* cited by examiner

METHOD AND SYSTEM FOR MANAGING TENSION AND MAINTAINING REGISTRATION BETWEEN MULTIPLE WEBS IN A WEB FINISHING SYSTEM

CROSS REFERENCE TO RELATED APPLICATIONS

This application claims the benefit of U.S. Provisional Application No. 60/481,188, filed Aug. 7, 2003.

BACKGROUND OF INVENTION

1. Field of the Invention

The present invention generally relates to printing equipment and processes. More particularly, this invention relates to a web finishing system suitable for use in inline and offline finishing systems in which multiple webs are simultaneously processed.

2. Description of the Related Art

In a typical inline printing and finishing apparatus used in the printing industry, a single paper web passes through a series of printing presses at high speeds before being printed (wetted), dried and cooled, after which the web undergoes a secondary finishing operation such as folding, perforating, gluing, die cutting and rotary cutting the printed web to a desired length. The speed at which a web can be printed and dried is typically higher than the speed at which finishing operations can be performed, such that the web finishing operation may artificially limit the speed at which finished printed material can be produced. As such, there are circumstances in which an offline web finishing system is desired.

If an offline web finishing system is used, printed webs are rewound at the end of the printing press line to form a preprinted roll ready for a secondary offline finishing operation. In the process of rewinding a preprinted web, it is difficult to maintain an even level of tension throughout the entire rewound web, even though the tension of the web is monitored through extreme care. Relatively small changes in web tension can cause significant print variation of the repeat length of a web's print image, which typically comprises multiple images that repeat as a set along the length of a printed web. Because paper is sensitive to environmental conditions such as humidity, another problem that arises with rewound webs is that during storage, the printed image may shrink, expand or do both within the same rewound web, depending on the conditions within the storage area. As a result, preprinted and rewound webs normally exhibit variations in the repeat length of its print image ("print image repeat length") throughout its length.

For economy and/or other considerations, preprinted and rewound webs are unspooled and registered (aligned) with each other so that the webs can together undergo the finishing operations necessary to produce a finished product. For this purpose, preprinted webs have registration marks printed thereon that can be detected with a registration scanning system to synchronize the finishing equipment with the printed images on the web. Nonetheless, print image registration can be a significant problem in web finishing, especially when dealing with multiple webs. More particularly, it is difficult to register the print images of two or more preprinted and rewound webs because, for the reasons discussed above, each web typically has a different trend of print image length variations that can be localized or cumulative.

The conventional method of operating a web finishing system that involves multiple rewound webs is to print one web, referred to herein as the "primary" web, to achieve a generally precise print image repeat length, while other ("secondary") webs are intentionally printed to have shorter image repeat lengths. This method requires stretching the images of the secondary web(s) in an attempt to match the primary web, or to shrink the image of the primary web to match the image of the secondary web through the finishing system. The former scenario is depicted in FIG. 1, which shows a primary web 10 and a secondary web 12 side-by-side instead of being registered with each other for purposes of clarity. As noted above, the primary and secondary webs 10 and 12 have print images 14 containing a series of individual images 20 and 22, respectively, that are repeated with each print image repeat length. As represented in FIG. 1, the secondary web 12 has been overstretched, such that the print image repeat length of the secondary web 12 is longer than that of the primary web 10, as evidenced by the phantom lines 16. In addition to such inaccuracies, the conventional method of stretching or shrinking webs may cause tension upset in the finishing operation and result in web break.

It is believed that a method does not exist in which an offline system is capable of dealing with the variation of the position of the print repeat and cumulative errors of the repeat length on webs that are aligned for simultaneously undergoing an operation. Accordingly, there is a need for a method capable of providing reliable and commercially acceptable finished products from multiple preprinted and rewound webs.

SUMMARY OF INVENTION

The present invention provides a system and method for effectively managing the tension and maintaining commercially acceptable print image registration between multiple preprinted and rewound webs in a web finishing system. The invention generally entails severing lengths of print images of a secondary web, and then individually aligning each length with those of a primary web prior to the finishing operations.

According to the invention, managing the tension and maintaining registration of a first web and at least second web being transported toward a finishing apparatus involves comparing relative positions of registration marks on the first and second webs, severing lengths of the second web in response to the relative positions of the registration marks, individually aligning each length of the second web with the first web, and then simultaneously performing a finishing operation on the first and second webs with the finishing apparatus. A system adapted for performing the method of this invention includes means for simultaneously performing a finishing operation on the first and second webs, means for transporting the first and second webs toward the finishing apparatus, means for comparing relative positions of registration marks on the first and second webs, means for severing lengths of the second web in response to the relative positions of the registration marks, and means for individually aligning each length of the second web with the first web before the first and second webs encounter the performing means.

From the above, it can be appreciated that the present invention provides an offline finishing system that is capable of dealing with variations in positions of print images on webs and the cumulative errors of the repeat lengths on webs that must be aligned before simultaneously undergoing a finishing operation. As such, the invention provides a system and method capable of providing reliable and commercially acceptable finished products from multiple preprinted and rewound webs.

Other objects and advantages of this invention will be better appreciated from the following detailed description.

DETAILED DESCRIPTION

Figure 3:
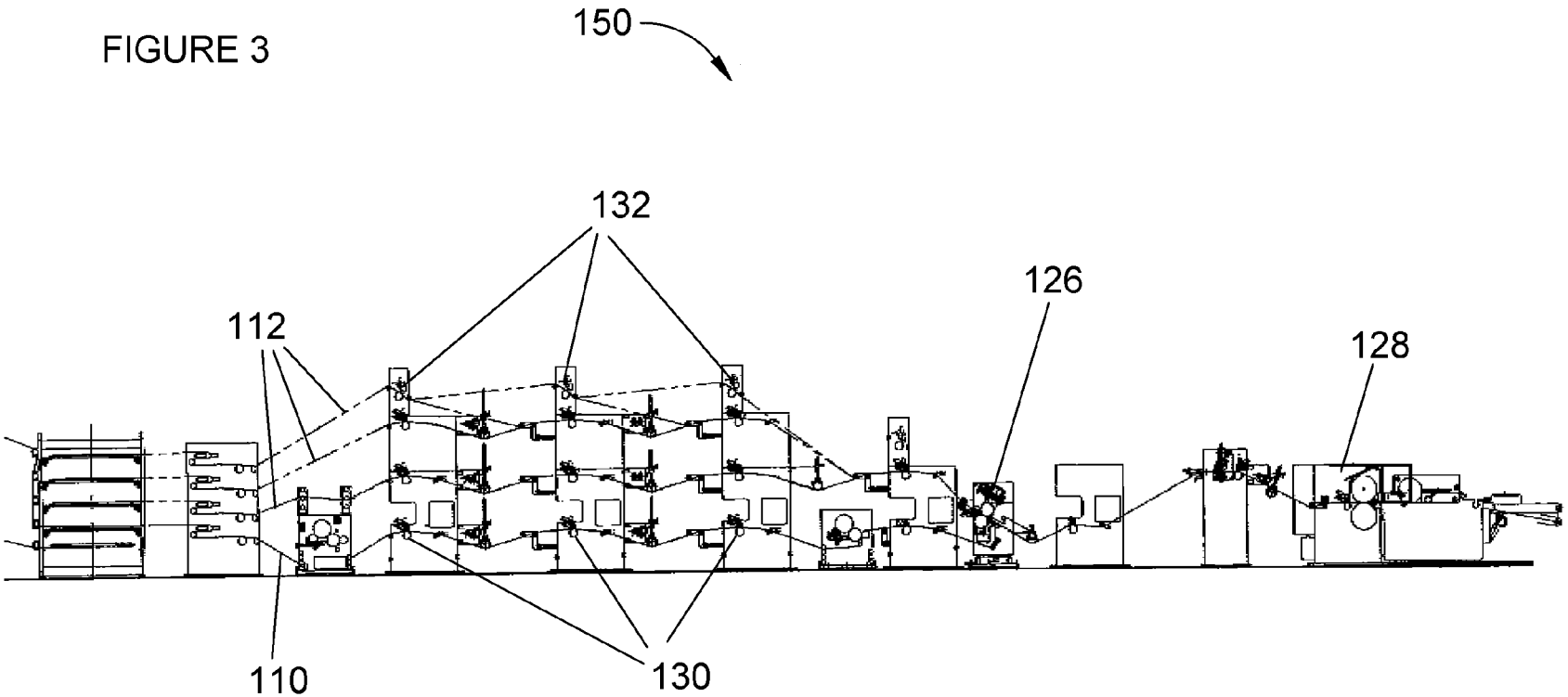
FIG. 3 represents an offline finishing system capable of handling multiple preprinted and rewound webs in accordance with the present invention.

The present invention relates to an offline web finishing system, a section of which is represented in FIG. 3 and identified with reference number 150. As with other finishing systems known in the art, the finishing system 150 of FIG. 3 comprises various pieces of equipment arranged in a line to simultaneously perform multiple functions on multiple preprinted and rewound webs 110 and 112. However, those skilled in the art will appreciate that the teachings of this invention could be applied to inline web finishing operations as well.

Figure 1:
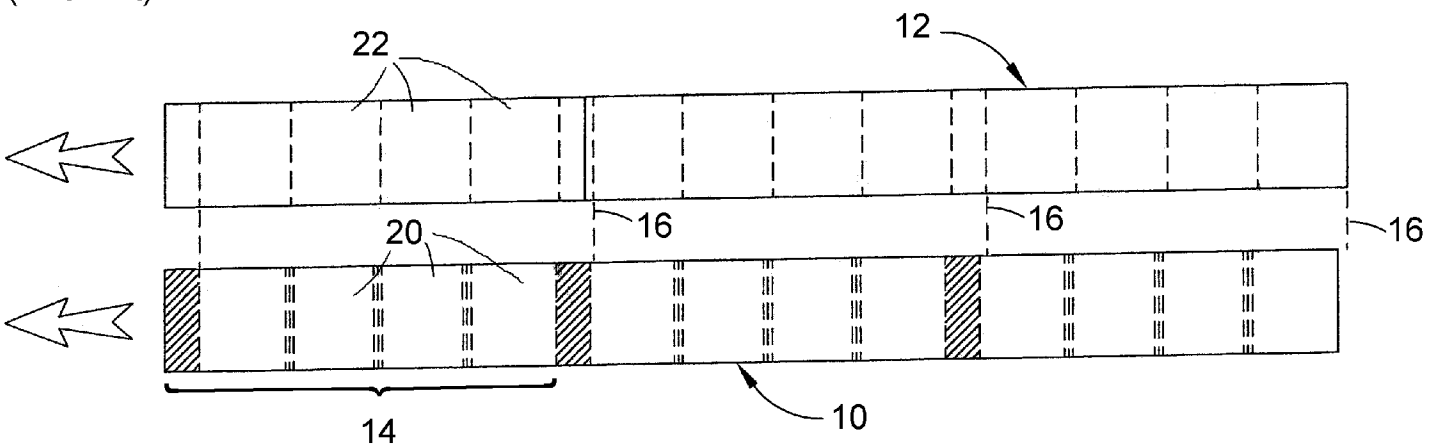
Figure 1 (Prior Art)
FIG. 1 shows a pair of primary and secondary webs of the type that are preprinted and rewound following a printing and drying operation, and shows print image repeat lengths of the secondary web differing in length from print image repeat lengths of the primary web in accordance with the prior art.

As is conventional, the machines of the web finishing system 150 (e.g., perforators, gluers, die cutters, rotary cutters, etc.) operate on the webs 110 and 112, which can be formed of the same or different substrate material (including weight and type). The webs 110 and 112 operated on by the web finishing system 150 of this invention can be essentially identical to the webs 10 and 12 represented in FIG. 1, which have repeat lengths of print images 14 of multiple individual images 20 and 22. To enable simultaneous operations to be performed on the webs 110 and 112, the webs 110 and 112 must be accurately registered with each other. As such, the machines of the web finishing system 150 are registration-sensitive and are therefore preferably equipped with an independent scanning system (not shown) capable of recognizing registration marks printed (or otherwise detectable) on the webs 110 and 112. Each machine is also conventionally equipped with at least one function cylinder (not shown) that, in combination with its scanning system and registration marks (124 in FIG. 2) on the webs 110 and 112, acts on the webs 110 and 112 in precise coordination with the print images 114 on the webs 110 and 112.

Each preprinted and rewound web 110 and 112 is transported throughout the finishing system 150 with its own transport system 130 and 132. Each transport system 130 and 132 generally includes a series of draw rollers that are driven independently to transport its web 110 and 112. The draw rollers of the different webs 110 and 112 can be operated at slightly different speeds to compensate for any misregistration to maintain the "local function" of the function cylinder of each machine without upsetting the web tension. At least one scanner is installed to monitor the printed registration marks 124 on the "primary" web 110 to generate a virtual master reference signal. This virtual master signal governs the speed of the transport system 130 for the primary web 110. The primary web 110 is not severed to the desired product length until it passes through a final rotary cutter 128.

Figure 2:
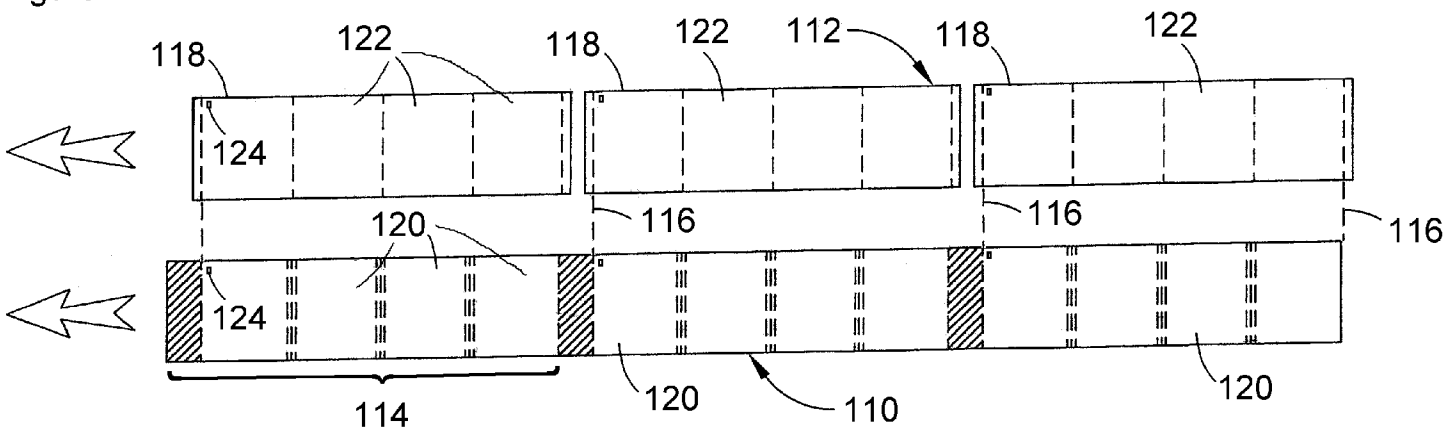
FIG. 2 shows a pair of primary and secondary webs of the same type as shown in FIG. 1, but in which the secondary web has been cut into lengths in accordance with the present invention so as to nullify any differences in print image repeat lengths between the primary and secondary webs, thereby enabling accurate registration of the secondary web with the primary web.

In FIG. 3, three webs 112 are shown being introduced into the web finishing system 150 prior to the final rotary cutter 128. These webs 112, referred to as the "secondary" webs 112, have their own independently driven draw roller transport systems 132. At least one secondary scanner is installed to monitor the speed of the secondary web transport system. The speed of the secondary web transport system 132 is determined by comparing the difference in distance between the printed registration marks 124 on the primary and secondary webs 110 and 112. By increasing or decreasing the speed of the secondary web transport system 132, the printed registration marks 124 of the secondary webs 112 can be brought in synchronization with the primary web 110. Before registration with the primary web 110, the secondary webs 112 are passed through at least one additional rotary cutting device 126 that is equipped with an independent registration scanning system and a function cylinder that is also in registration with the printed registration marks 124 of the primary web 110. As represented in FIG. 2, the pre-cutter 126 severs the secondary webs 112 into press repeat lengths 118 (one press repeat length 118 of a secondary web 112 may contain several equal lengths of finished product). These severed lengths 118 of the secondary webs 112 are then placed in register onto the primary web 110 by aligning their leading cut edges (produced by the severing operation) with the print images 114 of the primary web 110, as evidenced by the phantom lines 116 in FIG. 2. The primary web 110 is preferably folded over the lengths 118 of the secondary webs 112 to prevent their subsequent movement relative to the primary web 110. By severing the secondary webs 112 into lengths 118 that are individually registered with the primary web 110, differences in the behavior of the localized and cumulative errors of the webs 110 and 112 are eliminated. Also eliminated is the requirement to address any tension upset because of stretching or shrinking of the webs 110 and 112.

Figure 4:
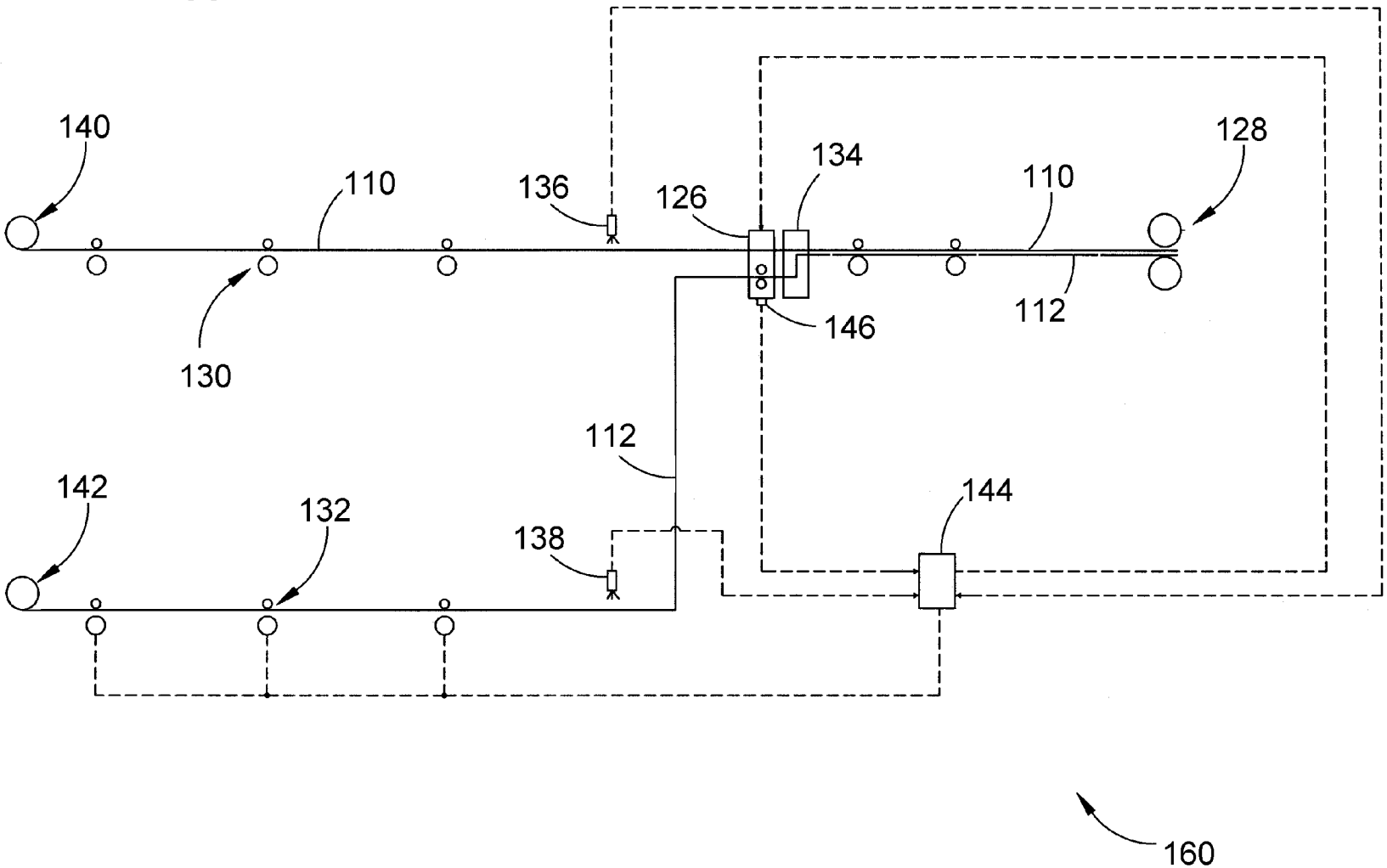
FIG. 4 represents a control scheme for making the cuts in the secondary web of FIG. 3 and then registering the secondary web with the primary web in accordance with the present invention.

A multiple web control system 160 that can be implemented with the web finishing system 150 of FIG. 3 is schematically represented in FIG. 4. The function of the control system 160 is to perform a multiple web offline operation without the concern for slight paper length variances of the webs 110 and 112. A key to accomplishing this task is the method of the registration control and keeping each web 110 and 112 independently controlled via their separate web transport systems 130 and 132.

In carrying out the control method, a virtual master reference signal is first generated. This signal is varied by the operators via control stations (not shown) that can be conventionally provided. The primary web 110 is locked into the speed of the virtual master signal. FIG. 4 shows the primary web 110 as being dispensed from a roll 140 and maintained as a continuous web until it is cut into products at the final rotary cutter 128, as discussed above. FIG. 4 also shows one of the secondary webs 112 dispensed from a roll 142 and driven by its own independent web transport system 132 to the pre-cutter 126, as discussed previously. The pre-cutter 126 cuts the secondary web 112, and a pre-cutter tape system 134 then places the severed web 112 into the continuous stream of the primary web 110 prior to encountering the final rotary cutter 128. More particularly, the tape system 134 preferably operates to individually align each length 118 of the secondary web 112 with the primary web 110 by aligning their leading cut edges with the print images 114 of the primary web 110 as shown in FIG. 2, before the webs 110 and 112 encounter the final rotary cutter 128. The tape system 134 also preferably performs the operation of folding the primary web 110 over the lengths 118 of the secondary webs 112 to prevent their subsequent movement relative to the primary web 110.

A key element is the synchronization of the webs 110 and 112, both the cut-to-image of the secondary web 112 in relationship to the pre-cutter 126 and the synchronization of the leading cut edge of the secondary web 112 in relationship to the print images 114 of the primary web 110, as evident from FIG. 2. A control concept capable of this is as follows. The primary web 110 is pulled via the virtual master-controlled web transport system 130, and all primary web tool cylinders are independently registered to the print images 114 of the primary web 110. The secondary web 112 requires two control steps. The first step is to register the knife position of the pre-cutter 126 against the primary web 110 with the use of a scanner 136 or other sensing device that monitors the primary web 110, e.g., via its registration marks. This information is fed back to a controller 144 that controls the pre-cutter 126 and the secondary web transport system 132. The second control step involves registering the print image 114 of the secondary web 112 to the knife position of the pre-cutter 126. Since the pre-cutter knife position is registered to the primary web 110, movement of the secondary web 112 to the pre-cutter 126 must also be controlled so that its print image 114 is also registered to the knife position of the pre-cutter 126. This position control is performed by the controller 144, whose input further includes a second scanner 138 (or other suitable sensing means) that monitors the secondary web 112 against the position of the tool cylinder on which the knife of the pre-cutter 126 is mounted. Using the positional feedback of the scanner 138, the web transport system 132 is operated to move the secondary web 112 to the pre-cutter 126 so that the printed image 114 of the secondary web 112 is synchronized with the pre-cutter knife, and therefore with the print image 114 of the primary web 110. The controller 144 also operates on the basis of feedback from a registration encoder 146 associated with the pre-cutter 126 to register the pre-cutter 126 against the primary web 110 and register the secondary web 112 against the pre-cutter 126.

While the invention has been described in terms of specific embodiments, it is apparent that other forms could be adopted by one skilled in the art. Accordingly, it should be understood that the invention is not limited to the specific embodiments illustrated in the Figures. In addition, the method and system of this invention could be used to process sheet materials other than printed paper, such as plastic, metal foils, etc. Therefore, the scope of the invention is to be limited only by the following claims.

The invention claimed is:

1. A method of managing tension and maintaining registration of a first web and at least one second web, the method comprising the steps of:

transporting the first and second webs toward a finishing apparatus;

comparing positions of registration marks on the first web to position of registration marks on the second webs;

severing lengths of the second web in response to the relative positions of the registration marks;

individually aligning each of the severed lengths of the second web with the first web; and then simultaneously performing a finishing operation on the first and second webs with the finishing apparatus.

2. The method according to claim 1, wherein the finishing operation performed by the finishing apparatus comprises a cutting operation in which the first and second webs are both cut.

3. The method according to claim 1, further comprising the step of folding the first web over the second web so as to secure the lengths of the second web within a fold of the first web after the individually aligning step and before the simultaneously performing step.

4. The method according to claim 1, wherein the comparing and severing steps comprise synchronizing the severing step with the registration marks on the first web, and synchronizing transporting of the second web with the severing step.

5. The method according to claim 1, wherein the method is performed on a plurality of second webs.

6. A method of managing tension and maintaining registration of print images on preprinted and rewound webs in a web finishing system, at least first and second webs of the preprinted and rewound webs having registration marks along lengths thereof that demarcate repeat lengths of the print images on the first and second webs, the method comprising the steps of:

transporting the first and second webs toward a finishing apparatus;

comparing positions of the registration marks of the first web to position of the registration marks of the second web as the first and second webs are transported toward the finishing apparatus;

severing lengths of the print images of the second web in response to the relative positions of the registration marks;

individually aligning each of the severed lengths of the second web with the first web so that the print images of the first and second webs coincide; and then simultaneously performing a finishing operation on the first and second webs with the finishing apparatus.

7. The method according to claim 6, wherein the finishing operation performed by the finishing apparatus comprises a cutting operation in which the first and second webs are both cut.

8. The method according to claim 6, further comprising the step of folding the first web over the second web so as to secure the lengths of the second web within a fold of the first web after the individually aligning step and before the simultaneously performing step.

9. The method according to claim 6, wherein the comparing and severing steps comprise synchronizing the severing step with the registration marks on the first web, and synchronizing transporting of the second web with the severing step.

10. The method according to claim 6, wherein the method is performed on a plurality of second webs.

11. A system for managing tension and maintaining registration of a first web and at least one second web, the system comprising:

means for simultaneously performing a finishing operation on the first and second webs;

means for transporting the first and second webs toward the finishing apparatus;

means for comparing positions of registration marks on the first web to position of the registration marks of the second web;

means for severing lengths of the second web in response to the relative positions of the registration marks; and means for individually aligning each of the severed lengths of the second web with the first web before the first and second webs encounter the performing means.

12. The system according to claim 11, wherein the performing means is a cutting apparatus adapted to simultaneous cut the first and second webs.

13. The system according to claim 11, further comprising means for folding the first web over the second web so as to secure the lengths of the second web within a fold of the first web before encountering the performing means.

14. The system according to claim 11, wherein the comparing and severing means comprise means for synchronizing the severing means with the registration marks on the first web, and means for synchronizing the transporting means with the severing means.

15. The system according to claim 11, wherein the system is an offline web finishing system.

16. A system of managing tension and maintaining registration of print images on preprinted and rewound webs in a web finishing system, the system comprising:

at least first and second webs having registration marks along lengths thereof that demarcate repeat lengths of the print images on the first and second webs;

a finishing apparatus for simultaneously performing a finishing operation on the first and second webs;

means for transporting the first and second webs toward the finishing apparatus;

means for comparing positions of the registration marks of the first web to position of the registration marks of the second web as the first and second webs are transported toward the finishing apparatus;

means for severing lengths of the print images of the second web in response to the relative positions of the registration marks; and means for individually aligning each of the severed lengths of the second web with the first web so that the print images of the first and second webs coincide before the first and second webs encounter the finishing apparatus.

17. The system according to claim 16, wherein the finishing apparatus is a cutting apparatus adapted to simultaneous cut the first and second webs.

18. The system according to claim 16, further comprising means for folding the first web over the second web so as to secure the lengths of the second web within a fold of the first web before encountering the finishing apparatus.

19. The system according to claim 16, wherein the comparing and severing means comprise means for synchronizing the severing means with the registration marks on the first web, and means for synchronizing the transporting means with the severing means.

20. The system according to claim 16, wherein the system is an offline web finishing system.

* * * * *